US006972387B2

(12) United States Patent
Berthaud

(10) Patent No.: US 6,972,387 B2
(45) Date of Patent: Dec. 6, 2005

(54) PADLOCKABLE PUSH-BUTTON

(75) Inventor: Denis Berthaud, Saint Michel (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 11/002,325

(22) Filed: Dec. 3, 2004

(65) Prior Publication Data

US 2005/0133348 A1 Jun. 23, 2005

(30) Foreign Application Priority Data

Dec. 9, 2003 (FR) ..... 03 14423

(51) Int. Cl.[7] ..... H01H 9/28
(52) U.S. Cl. ..... 200/43.13; 200/43.18; 200/322
(58) Field of Search ..... 200/50.01–50.04, 200/43.01, 43.07, 43.11, 321, 43.12, 322, 200/43.13, 327, 43.16, 43.18, 43.19, 43.21

(56) References Cited

U.S. PATENT DOCUMENTS 2,370,877 A * 3/1945 Robbins ..... 200/50.11
2,673,259 A 3/1954 Appleton et al.
2,752,440 A * 6/1956 Robbins ..... 200/43.13
2,752,441 A * 6/1956 Frank ..... 200/43.13
2,850,587 A 9/1958 Nolden et al.
3,283,608 A * 11/1966 Davis et al. ..... 200/43.13
3,384,727 A 5/1968 Zavertnik et al.
4,154,125 A * 5/1979 Frank ..... 200/43.16
4,191,066 A * 3/1980 Keranen ..... 200/43.13
4,851,621 A 7/1989 Borchardt et al.
5,808,252 A 9/1998 Makuc et al.

* cited by examiner

*Primary Examiner*—Michael A. Friedhofer
(74) *Attorney, Agent, or Firm*—Oblon, Spivak, McClelland, Maier & Neustadt, P.C.

(57) ABSTRACT

Maintained contact push-button, particularly an emergency stop button, provided with a padlocking accessory.

The button has a barrel and a movable head. The accessory has a sleeve fixed with respect to the barrel and having an inner shape matching the upper part of the barrel, and a movable ring. The ring has at least one aperture for the passage of padlocks on its upper edge, and is mounted on the outside of the sleeve so that it can move between a lower inactive position and an upper active position, by a movement which is limited by means of stop elements, in such a way that the head is left free in the lower position and the upper edge of the ring rises above the head in the upper position.

7 Claims, 2 Drawing Sheets

PADLOCKABLE PUSH-BUTTON

The present invention relates to a maintained contact push-button, particularly an emergency stop button, intended to operate a switch member and comprising a movable actuating head and a fixed elongate barrel.

Push-buttons of this type are intended to be mounted on a flat support, the head being slidable along a principal axis perpendicular to the support to assume an outer position and a pushed-in position. The barrel is designed to pass through an opening in the support and be fixed under the support. The term "maintained contact" indicates that a pressure applied to the button causes it to move downwards towards a pushed-in position which is maintained, the initial position being regained only by a new action performed manually, directly or by means of a key, on the button.

In emergency stop buttons (see for example FR 2,521,768) the switch member is operated by a quick break mechanism which is triggered when the user exerts a pressure on the head, in order to activate an electrical safety circuit. The button can then be returned to its original state by resetting the mechanism by means of a rotary or pulling action on the head.

It is desirable to be able to padlock a maintained contact push-button, and particularly an emergency stop button, to prevent an operator from inappropriately returning the head to its initial outer position. There are known locking devices with padlockable swinging guards, but these devices are relatively complicated and rather inconvenient.

There is also a known way of using a tulip-shaped accessory, fixed around the button (Schneider Electric catalogue, "Automatismes Industriels 2001", page C100), for padlocking an emergency stop button. An accessory of this kind has apertures on its upper edge which are left free to allow the insertion of padlocks when the head has been activated and pushed in. The drawback of this accessory is that it interferes with the manual operation of the head of the button.

The object of the invention is to enable a maintained contact push-button, particularly an emergency stop button, to be padlocked by means of a simple accessory which is well adapted to the structure of the button and does not interfere with the operators actuation of the head of the button.

According to the invention, the padlocking accessory comprises:

- a sleeve which is fixed with respect to the barrel and has an internal shape matching the upper part of the barrel,
- a ring having at least one aperture for the passage of a padlock on its upper edge, the ring being mounted on the outside of the sleeve so that it can move between a lower inactive position and an upper active position, in a movement limited by stop elements, in such a way that the head is left free in the lower position and the upper edge of the ring rises above the head in the upper position.

The ring, which preferably slides with respect to the sleeve and is prevented from turning by indexing elements, can have a stop which, in the upper position, interacts with an external collar located on top of the sleeve. The fitting of the accessory can be facilitated if the sleeve has in its lower part an inner support on which an annular flange of the push-button rests. It is advantageous for the upper edge of the ring to have two upwardly open cut-outs which facilitate the gripping of the actuating head when the ring is in the lower, idle position.

Preferably, the padlocking accessory is a one-piece sub-assembly formed by a telescopic assembly of the ring with the sleeve, so that it can be fitted in one piece to the push-button.

The invention also relates to the padlocking accessory properly so called, which is provided with a sleeve and a ring mounted on the outside of the sleeve, the ring having on its upper edge at least one aperture for the passage of padlocks, and being movable between a lower inactive position and an upper active position, in a sliding movement limited by means of stop elements, while remaining fitted on the sleeve.

The following detailed description, which refers to the attached drawings, illustrates an embodiment provided by way of example.

Figure 8:
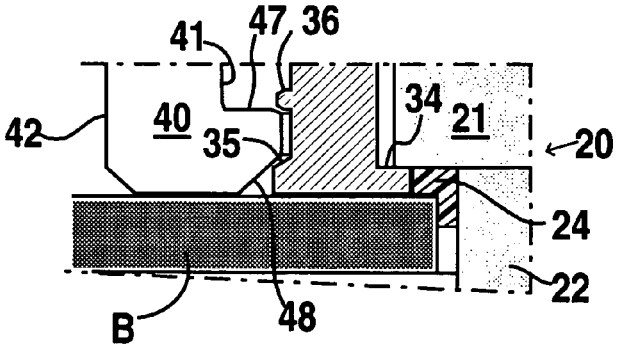
FIG. 8 shows the enlarged detail E of FIG. 6.

The emergency stop button A shown in the figures is intended to be mounted on a flat support B (see FIGS. 6 to 8) such as a panel, desk, cabinet, etc., and it is provided with a padlocking accessory C which can receive one or more padlocks D. The button A is a solid of revolution about an axis X and has a sliding push head 10 and a fixed cylindrical barrel 20. The push head 10 has a flared part 11 for actuation by the operator and a cylindrical skirt 12 guided on the barrel. The barrel 20, which in a variant form could be prismatic, has an upper part 21 for guiding the head, and a lower part 22 for fixing against the reverse of the support by means of an element 23 of any known type (using, for example, a nut or a fixing base with a gripping screw). A joint 24 is provided to form a seal for the passage of the barrel through a circular opening 25 in the support B, the joint being placed on a flange 26. The barrel includes a mechanism for activating an electrical circuit to which the invention does not relate.

Preferably, the padlocking accessory C consists of a telescopic one-piece sub-assembly, formed by the permanent assembly of a sleeve 30 and a ring 40 which is movable with respect to the sleeve, the sub-assembly being added to the push-button in such a way as to enclose it without interference.

The sleeve 30 is positioned in such a way as to enclose the barrel 20 while leaving the actuating part 11 of the head free, both in its outer position and in its pushed-in position. It has a cylindrical inner face 31 matching the outer shape of the barrel, and an outer face 32 in the form of cylindrical parts. On its upper end, the sleeve has an outer collar 33 acting as an upper stop for the ring; on its lower end, the sleeve has an inner support 34 to receive the barrel and an outer bearing surface 35 limiting the downward movement of the ring (see FIG. 8). The terms "inner" and "outer" denote the ends of the parts located radially towards the inside and towards the outside respectively.

A space to house the skirt 12 of the head 10 is formed between the inner face 31 of the sleeve and the opposite face of the barrel. A latching element 36, friction point or similar retaining element is provided to keep the ring in the lower position on the sleeve, and an indexing element 37 is provided to guide the movement of the ring (see FIG. 6). A latching element 38, friction point or similar retaining element is also provided to keep the ring in the upper position on the sleeve (see FIG. 7, where the element 38 is shown in a cross section taken through a different diametric plane from that of FIG. 6).

The ring 40 is movable by translation in the direction X with respect to the sleeve 30, by a movement limited upwardly by the collar 33 and downwardly by the bearing surface 35. The ring has an inner face 41 and an outer face 42, both cylindrical. A wide lateral opening 43 is provided to facilitate the juxtaposition of buttons in a confined space. The ring has an upper edge 44 which has, on the one hand, three apertures 45 for the passage of different padlocks, these apertures being spaced at 120°, and, on the other hand, two cut-outs 46 open upwardly and diametrically opposed, intended to facilitate the gripping of the head when it is pulled for resetting. The ring 40 has an inner stop 47 designed to interact with the collar 33 of the sleeve 30 in its lower part, and has a bevelled or rounded edge 48 towards its interior. A groove 49 running along the axis X is provided inside the ring to guide the indexing element 37 (a ball, pip or similar element) provided on the outside of the sleeve.

Figure 1:
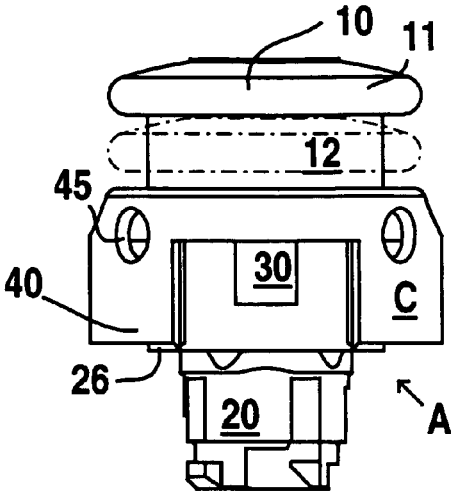
FIG. 1 shows in elevation a padlockable emergency stop button according to the invention, the button being shown in the inactive position.
Figure 4:
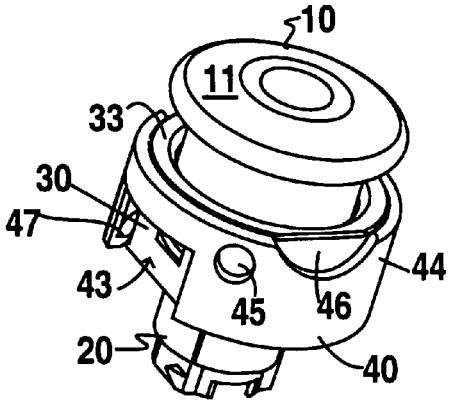
FIGS. 4 and 5 show the button in perspective, in positions corresponding to FIGS. 1 and 2.
Figure 6:
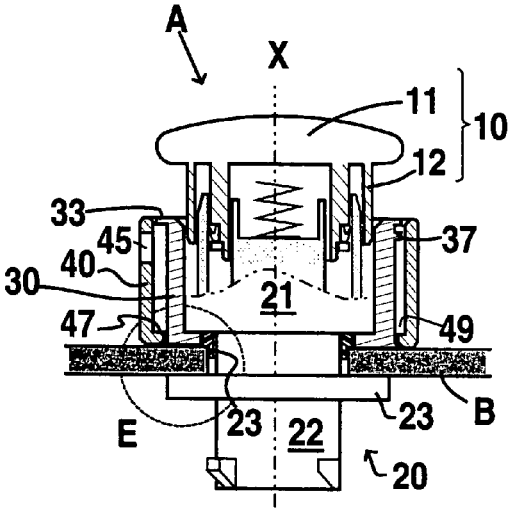
FIGS. 6 and 7 are diametric cross sections of the button of FIGS. 1 and 2.

The operation of the padlocking accessory will be explained with reference to the figures. FIGS. 1, 4 and 6 show the emergency stop button A in the idle position. The sleeve 30 encloses the barrel and rests on the upper face of the support B. Rectilinear clearances can be provided under the sleeve to align it on a supporting rib which may be present. The padlocking ring 40 is kept in the lower position on the sleeve by the pressure of its edge 48 against the outer bearing surface 35 of the sleeve. If there is an emergency stop, the operator presses the head 10 which moves to the position shown in broken lines in FIG. 1. It should be noted that the padlocking accessory is shaped and positioned in such a way that it does not interfere with the movement of the button by the operator.

If the operator does not wish to padlock the button, he can easily grip the part 11 of the head which is now pushed in, and impart a pulling or rotary movement to it to reset the button, the head returning to its normal inactive position. The cut-outs 46 enable him to obtain a better grip on the edge of the part 11 if required.

Figure 2:
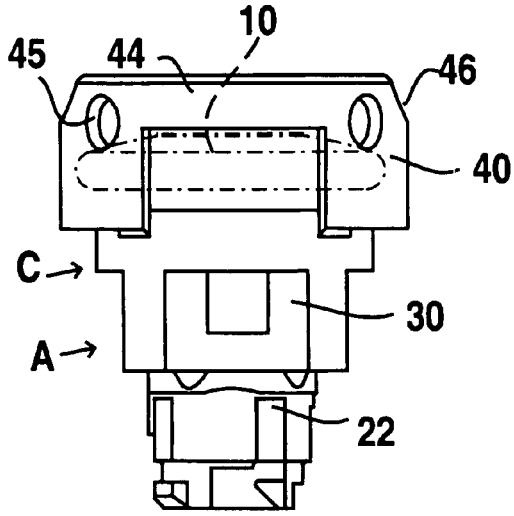
FIG. 2 is a similar view, showing the button ready to be padlocked.
Figure 3:
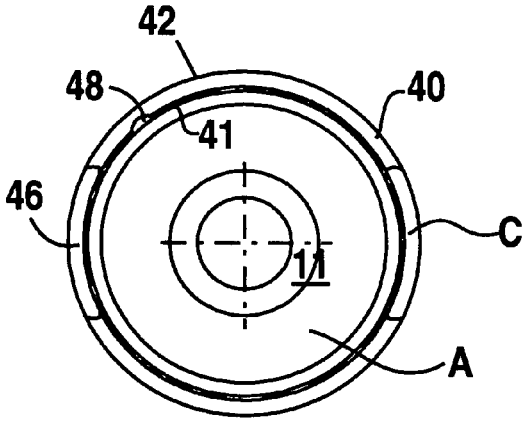
FIG. 3 is a view from above of the button of FIGS. 1 and 2.
Figure 5:
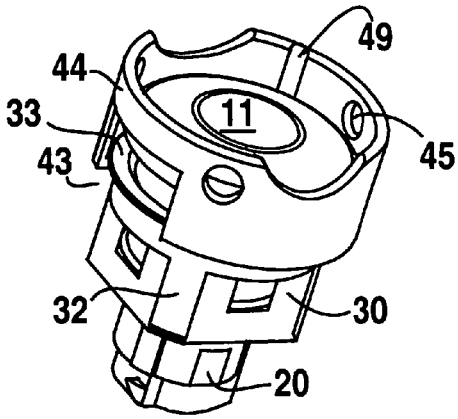
Figure 7:
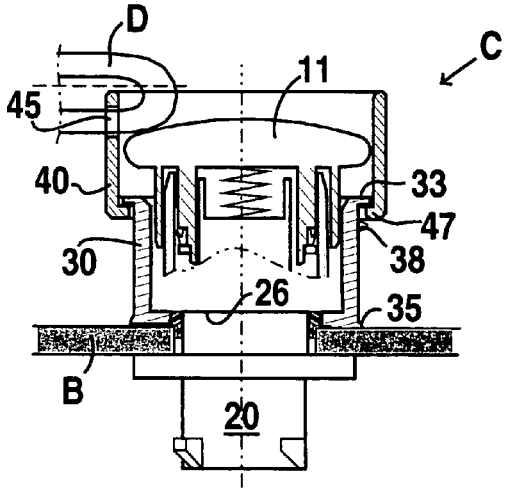

If the operator wishes to padlock the button, he raises the ring which passes over the friction point 36 and slides along the sleeve, the indexing element 37 of the sleeve sliding in the guide groove 48. When the stop 47 bears on the collar 33 (FIGS. 2, 5 and 7), the ring has reached its upper active position. The apertures 45 are then sufficiently distant from the flared part 11 of the head to enable one to three padlocks D to be attached, as shown in FIG. 7. To unpadlock the button, the operator removes the padlock D and lowers the ring which slides along the sleeve until it bears on its bearing surface 35 and/or on the support B. He can then return the button to its idle position.

What is claimed is:

1. Maintained contact push-button for positioning on a flat support, comprising a fixed elongate barrel (20) and a movable actuating head (10) mounted movably on the barrel, the head being slidable along a principal axis (X) to assume an outer position and a pushed-in position, the barrel having an upper part to be positioned above the support and a lower part which can pass through an opening in the support, a padlocking accessory being associated with the button to lock the actuating head in the pushed-in position, characterized in that the padlocking accessory (C) comprises:

a sleeve (30) which is fixed with respect to the barrel (20) and has an internal shape matching an upper part (21) of the barrel, a ring (40) having at least one aperture (45) for passage of a padlock on an upper edge (44), the ring being mounted on the outside of the sleeve so that the ring can move between a lower inactive position and an upper active position, by a movement which is limited by stop elements (33, 47), in such a way that the head is left free in the lower position and the upper edge (44) of the ring rises above the head in the upper position.

2. Push-button according to claim 1, characterized in that the ring (40) has a stop (47) which, in the upper position, interacts with an outer collar (33) located at the top of the sleeve (30).

3. Push-button according to claim 1, characterized in that the ring (40) slides with respect to the sleeve (30) and is prevented from turning by indexing elements (37, 49).

4. Push-button according to claim 1, characterized in that the sleeve (30) has in a lower part an inner support (34) on which an annular flange (26) of the barrel (20) of the push-button rests.

5. Push-button according to claim 1, characterized in that the padlocking accessory (C) is a one-piece sub-assembly formed by the telescopic assembly of the ring (40) with the sleeve (30).

6. Push-button according to claim 1, characterized in that the upper edge (44) of the ring (40) has two upwardly open cut-outs (46) which facilitate the gripping of the actuating head (10) when the ring is in the lower inactive position.

7. Padlocking accessory for a maintained contact push-button characterized by a sleeve (30) and a ring (40) mounted on the outside of the sleeve, the ring having on an upper edge (44) at least one aperture (45) for the passage of padlocks, and being movable between a lower inactive position and an upper active position, by a sliding movement limited by means of stop elements (33, 47), while remaining fitted on the sleeve.

* * * * *